United States Patent [19]

Nabucet et al.

[11] 4,057,026

[45] Nov. 8, 1977

[54] PYROTECHNIC CUTTER APPARATUS

[76] Inventors: Georges Joseph Marie Nabucet, 32 rue des 2 freres Guezenec; Michel Andre Champ, 35 rue Erwan Marec, both of 29200 Brest, France

[21] Appl. No.: 705,888

[22] Filed: July 16, 1976

[30] Foreign Application Priority Data

Aug. 14, 1975 France ..... 75.25313

[51] Int. Cl.[2] ..... B63B 9/00

[52] U.S. Cl. ..... 114/221 A; 102/24 HC; 166/54.5

[58] Field of Search ..... 114/221 A, 221 R; 83/53, 177; 30/DIG. 4; 166/54.5, 54.6; 89/1 B; 102/24 HC

[56] References Cited

U.S. PATENT DOCUMENTS

| | | | |
|---|---|---|---|
| 2,920,532 | 1/1960 | McBride | 89/1 B |
| 3,765,333 | 10/1973 | Reed et al. | 114/221 A |

FOREIGN PATENT DOCUMENTS

| | | | |
|---|---|---|---|
| 2,114,409 | 6/1972 | France | 114/221 A |
| 2,082,934 | 12/1971 | France | 114/221 A |
| 2,071,315 | 9/1971 | France | 114/221 A |
| 1,604,952 | 8/1972 | France | 114/221 A |
| 1,336,080 | 11/1973 | United Kingdom | 114/221 A |

*Primary Examiner*—Trygve M. Blix
*Assistant Examiner*—Sherman D. Basinger
*Attorney, Agent, or Firm*—Stevens, Davis, Miller & Mosher

[57] ABSTRACT

A pyrotechnic cutter for cutting an object such as a buoy-rope, tube, cable or the like and adapted to be mounted on a submarine vehicle, and including a fixed arm containing an explosive charge having a dihedral covering, and a second arm pivotally mounted to the fixed arm through a body portion which operatively engages an ejector which is adapted for engagement in the free end of a gun barrel, the ejector having an electrical circuit and a pyrotechnic circuit for ejecting the body having the arms, and detonating the explosive charge after a suitable time lag, so that explosion of the charge cuts the object.

16 Claims, 9 Drawing Figures

VIII
VI

PYROTECHNIC CUTTER APPARATUS

The present invention relates to a pyrotechnical cutter the charge of which has a dihedral covering or casing and, in particular, to a cutter designed to cut the buoy-ropes of marine mines.

It is already known to employ pyrotechnical cutter, towed by ropes behind mine-sweepers, for cutting the buoy-ropes of marine mines which then ascend to the surface where they are destroyed. By way of example, cutters of this type are disclosed in French Pat. Nos. 1,604,952, and 2,114,409, and in British Pat. No. 1,336,080.

In the remainder of the description, consideration will more particularly be given to a cutter which is not intended to be towed rearwardly of a mine sweeper, but which is designed to be disposed individually on a predetermined buoy-rope, tube or cable, prior to cutting that buoy-rope, tube, cable or the like.

Consequently, it is one of the objects of the invention to provide a cutter wherein the cutting is achieved by a hollow charge effect, thereby substantially increasing the depth at which the cutter may be utilized.

It is a further object of the invention to provide a cutter which may be mounted on a submarine vehicle or submarine device guided by a wire and capable of transporting the cutter up to the buoy-rope to be cut, of depositing the cutter on the rope and, finally, triggering functioning of the cutter after a pre-determined period of time enabling the submarine device to be recovered or efficiently removed.

A further object of the invention is providing a cutter affording, during manipulation thereof and during transport thereof by the submarine device, the achievement of maximum security againt untimely functioning.

A further object of the invention is providing a cutter in which the hollow charge is a charge having a dihedral covering or casing. Dihedral charges or the like generally, are already known, for example as described in French Pat. Nos. 2,071,315 and 2,082,934. The dihedral charge produces a practically identical cutting effect over its entire length.

According to one feature, there is provided a pyrotechnical cutter one of the arms of which contains a dihedral charge over practically its entire useful length, the plane of symmetry of the dihedral, i.e. the plane of the cutting jet of the charge, being directed toward the other arm of the cutter, and the explosion of the charge cutting any object enclosed between the two arms.

According to a further feature, there is provided a dihedral charge cutter initiated at one end and simultaneously at three points which are not aligned, one of which is in the plane of symmetry of the dihedral, near the edge thereof, whereas the two others are disposed symmetrically relative to said plane of symmetry.

According to a further feature, the cutter which is designed to be mounted on a submarine device comprises an ejector adapted to be engaged in a gun barrel fastened to the submarine device, a body fastened to the arm containing the dihedral charge and on which the second arm is articulated, the body being separated from the assembly of the barrel and of the ejector at the instant of functioning of the ejector, the body carrying means for controlling the opening and closing of the arms of the cutter, said control means maintaining the arms open for as long as the ejector has not functioned and closing the arms as soon as the body is separated from the barrel-ejector assembly, said separation triggering in the body, after a pre-determined delay, initiation of the dihedral charge of the first arm.

According to a further feature, the ejector-body assembly is able to rotate in the barrel and to adopt two positions, one wherein said control means takes a third inoperative position while closing the arms, and the other wherein said control means functions as indicated hereinabove.

According to a further feature, the means for initiating the dihedral charge comprise an electrical circuit and a pyrotechnical circuit, the electrical circuit comprising a source of primary energy, a delay circuit and a switching circuit, the source functioning subsequent to ejection of the body and transmitting a signal to the delay circuit the output of which feeds the switching circuit, the pyrotechnical circuit comprising a detonator and a pyrotechnical relay capable of exciting, along three paths, the explosive disposed at three initial points of the dihedral charge, the switching circuit feeding the detonator.

According to a further feature, the source of primary energy comprises primary cells adapted to be primed by sea water and disposed in a fluid-tight cavity for as long as the cutter is not deposited on the buoy-rope.

According to a further feature, the switching circuit is controlled mechanically by a hydrostatic piston which, in the inoperative position, short circuits in the switching circuit the wires connected to the input of the detonator and opens the wires connected to the output of the delay circuit and which, in the operative position, reached when the hydrostatic pressure applied is sufficient, connects the wires of the output of the delay circuit to the input wires of the detonator.

According to a further feature, the piston comprises a head which, in the inoperative position, projects externally of the body, the said head comprising a groove in which is lodged either a locking clip or a heel fastened to the second arm when it is open, in such a manner as to maintain the piston in the inoperative position and to prevent the piston from accidentally being depressed.

According to a further feature, the central portion of the piston is disposed between the detonator and the pyrotechnical relay, having a solid portion providing a screen between them when the piston is in the inoperative position, and an orifice permitting action of the detonator on the pyrotechnical relay when it is in the working position.

According to a further feature, the gun barrel comprises two pins aligned parallel to the axis of the barrel-ejector-body assembly, and the means for controlling the opening and closure of the arms comprises a sleeve adapted to slide without rotating on said body, the sleeve comprising a collar in which, at the same distance from the axis as the pins, there are formed on the one hand two dimetrically opposite cups which are, however, offset through 90° relative to the notches, said sleeve being constantly urged toward the ejector by a spring and the ejector-body assembly being, in the initial inoperative position, oriented in such manner that the pins of the barrel pass through the notches in the collar, thereby permitting the spring to urge the sleeve close to the ejector to close the arms and, in the working position, after having rotated through 90°, oriented in such manner that the pins have their ends bearing in the notches of the collar, thereby maintaining the sleeve away from the barrel. While compressing the spring and resulting in opening of the arms and, once the body has been separated from the ejector, the sleeve is once again urged by the spring, to again close the arms.

According to a further feature, the second mobile arm is connected to the sliding sleeve by links, the movement of the sleeve being transmitted to the second arm by the links to open or close the arms but, conversely, manual opening of the arms causing the sleeve to slide while compressing the spring.

According to a further feature, the ejector comprises an electrical igniter triggering ejection, the igniter being fed by a pin embedded in an axial jack of the barrel, the functioning of the igniter being initiated by an electrical signal applied to the jack by a circuit of the submarine device.

The features mentioned hereinabove, and also further features, are explicitly described in the description given hereinbelow of an exemplary embodiment of the invention, said description being given with reference to the accompanying drawings, in which.

Figures 1, 2, 8:
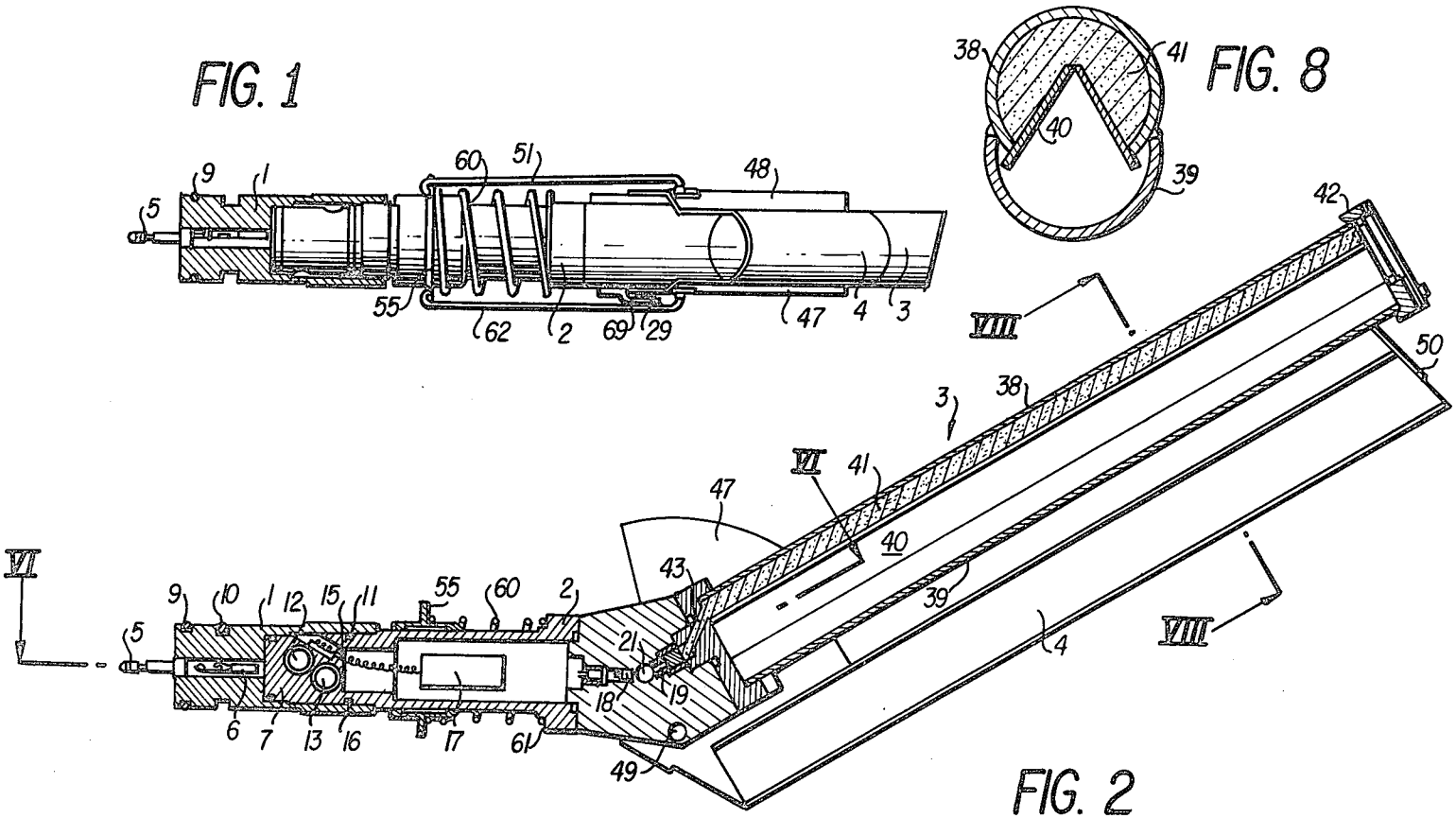
FIG. 1 is a partial lateral view, with partial sectioning, of the body and of the ejector of a cutter according to the invention.
FIG. 2 is a view in horizontal section of the ejector and of the body of a cutter according to the invention.
FIG. 8 is a view in section of the arm containing the dihedral charge, taken along the line VIII—VIII of FIG. 2.

Referring first to FIGS. 1 and 2, it will be seen that the cutter of the invention comprises an ejector 1 and a body 2 to which is fastened a first fixed arm 3, and on which is articulated a second mobile arm 4.

The ejector 1 is a body of revolution comprising an electrical pin of revolution 5, the cylindrical seating of small diameter in which is lodged an electrical igniter 6 the input wires of which are connected to the wires of the pin 5, and a cylindrical seat of large diameter designed to receive one end 7 of the body 2. The ejector 1 is provided to be lodged in a barrel 8 (FIG. 3), the pin 5 being engaged in an axial jack (not shown) to connect the input wires of 6 to the output wires of a control circuit of a telecontrolled submarine device carrying the gun barrel 8. The outer surface of the ejector 1 is formed with two circular grooves, one in which is disposed a toroidal packing 9 providing for fluid-tightness between the gun barrel and the ejector while at the same time preventing the water from reaching the pin 5, and the other in which is disposed a tangent pin 10 engaged in aperatures 70 and 71 of the gun barrel 8. The tangent pin 10 prevents any movement of translation of the ejector 1 relative to barrel 8, but does not prevent rotation of the ejector 1 in barrel 8. A pin 11 engaged in an aperature formed in the wall of ejector 1, surrounding body 2 and embedded in a blind aperature formed in body 2, serves to make the body 2 fast in the ejector 1.

The seating of the igniter 6 communicates with that of the body 2 in such manner that functioning of the igniter 6 ejects the body 2 from the ejector 1, the pin 11 being sheared during ejection.

The portion 7 of the body 2 contains in seats provided for this purpose two primary cells 12 and 13 adapted to be primed by sea water, the output wires 14 of which enter the interior of the body 2 passing through fluid-tight seals 15. The external surface of the portion 7 is formed with a groove in which is lodged a toroidal packing 16 providing for fluid-tightness between the inner surface of the ejector 1 and the inner portion 7 of body 2 at the same time preventing sea water from reaching the primary cells 12 and 13 for as long as ejection of the body 2 has not taken place.

Figure 6:
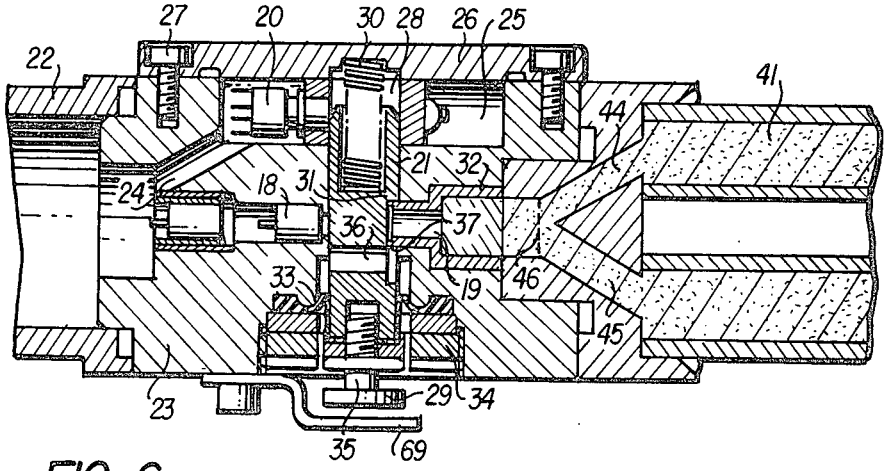
FIG. 6 is a view in cross section of the cutter taken along the line VI—VI of FIG. 2.

Provided within the body 2 is a fluid-tight compartment containing an electrical delay system, such as a delay line or an equivalent component (symbolically illustrated by the rectangle 17) a detonator 18, a pyrotechnical relay 19, microswitches or microcontacts 20 and a piston 21. In fact, the inner compartment of body 2 comprises a plurality of branches shown in FIG. 2 and in FIG. 6, which is a section taken along the line VI—VI of FIG. 2. It should also be noted that the body 2 is in fact in two parts, one 22 of generally cylindrical shape which comprises the portion 7, and the other 23 of prismatic shape — these parts being connected by screws or bolts (not shown). The portion 22 comprises a cylindrical cavity in which the circuit 17 is lodged. The portion 23 comprises, in the axis of ejector 1, an aperature in which is lodged the detonator 18, in the axis of the arm 3, an aperature in which is lodged the pyrotechnical relay 19, an oblique aperature 24 communicating with a cavity 25 where the microswitches 20 are lodged, said cavity 25 being produced by forming a hollow in the body and then sealing the hollow with a plate 26 fastened with part 23 by screws or bolts 27, and finally an aperature the axis of which is perpendicular to the plane defined by the axes of ejector 1 and arm 3, and in which the piston 21 is lodged. As FIG. 6 shows, the piston 21 comprises a piston body entirely contained in the aperature 28 and the head 29 externally of aperature 28 and projecting relative to part 23. The aperature 28 debouches into the cavity 25. The piston 21 has, at the end adjacent to plate 26, a blind axial aperature in which is engaged a spring 30 bearing on plate 26 and urging piston 21 in such manner that the head of piston 21 projects externally from part 23. Urged by spring 30, piston 21 is arrested by a shoulder provided in its lateral surface and which comes into abutment at 31 with the end of a member 32 in which the pyrotechnical relay is disposed and which projects into the aperature 28. The body of piston 21 is insulated from the exterior by a diaphragm 33 the edges of which are wedged against 23 and a washer by a plug 34 screwed into part 23. The plug 34 is formed with a central aperature through which the head 29 is screwed into the body of piston 21 to apply the diaphragm by means of a washer on the body. The head 29 is formed with a circular groove 35 the purpose of which will be described later. The aperature 24 serves for passage of electrical wires between the microswitches 20, and on the one hand, the delay circuit 17, and on the other hand, the electrical detonator 18.

Normally in air at normal atmospheric pressure, the pressure on the head 29 is balanced by the internal pressure in the compartment of the body 2 and the spring 30 maintains the piston 21 in the position indicated in FIG. 6. When the cutter has descended to a pre-determined depth, the hydrostatic pressure applied on the head 29 becomes preponderant and the piston is depressed into the aperture 28 to adopt its working position. In the inoperative position, the body of piston 21 constitutes a screen between detonator 18 and pyrotechnical relay 19, preventing untimely functioning of detonator 18 being relayed by relay 19 towards the charge of the arm 3. This is one of the safety measures for preventing a surface explosion. In the operative position, the body 21, which is recessed at 36, permits the detonator 18 to excite the relay 19. In this case, the position of 21 is defined by a shoulder which comes into abutment at 37 against member 32. On the other hand, in the operative position, the end of piston 21 (close to 26) mechanically actuates the microswitches 20. This is a further safety measure.

The active, fixed arm 3 (FIGS. 2 and 8) comprises two partially cylindrical portions 38 and 39 which are portions of hollow metal tubes connected to form a figure-eight shaped section eight. Secured in the tube 38, along the two generatrices, is a dihedral 40 which, in cross-section, forms a V extending into portion 38. The dihedral 40 is for example made from copper, i.e. from a dense material, and defines the hollow volume of the hollow charge between the wall of 39 and the dihedral 40. The volume enclosed between portion 38 and dihedral 40 is filled with explosive 41. At the end 42 of the arm 3 there are provided means for providing fluid-tightness of the space filled with explosive and of the space filled with air between 40 and 39. At the other end, the air space is also sealed, but the explosive space communicates via three ducts 43, 44 and 45 with the outlet of the pyrotechnical relay 19, as shown in FIGS. 2 and 6. The lengths of the ducts 43, 44 and 45 are equal in such manner that the detonation initiated at 46, appears simultaneously at three coplanar points which are judiciously arranged, in such manner as to set up a plane detonation wave in the charge, this wave being displaced along the arm 3 towards 42.

The mobile arm 4 is a hollow tube mounted on a pair of plates 47 and 48, each disposed at one side of the body 2 and fastened with a pivot 49 adapted to pivot in the element 23. At the end of the arm 4 there is provided an arresting plate 50 providing between 3 and 4 a free space and preventing the cable or the rod to be cut from escaping from the cutter when the latter is in the closure position, just before functioning thereof.

Figure 3:
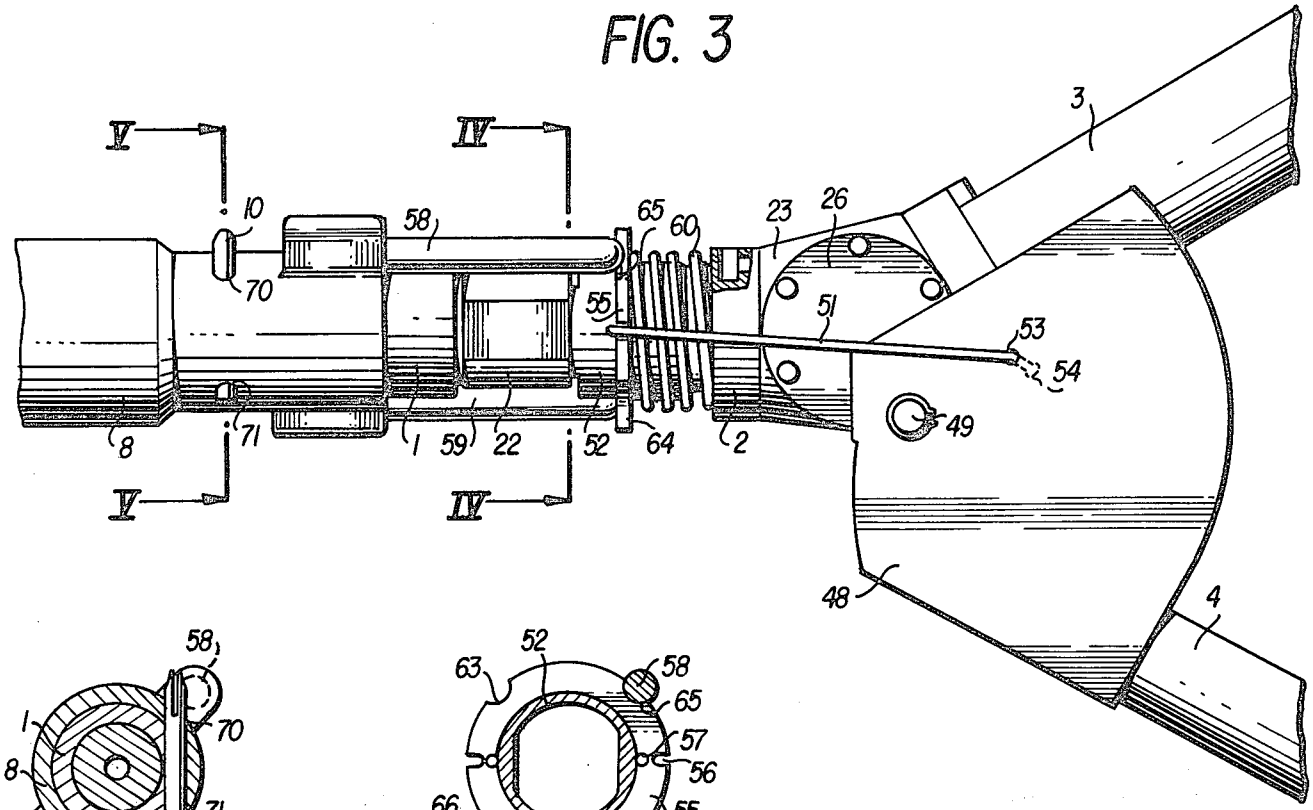
FIG. 3 is a partial plan view of the barrel in which is lodged a cutter according to the invention.
Figure 4:
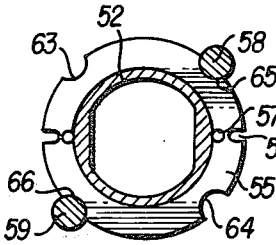
FIGS. 4 and 5 are, respectively, views in cross section of the cutter taken along the lines IV—IV and V—V of FIG. 3.
Figure 7:
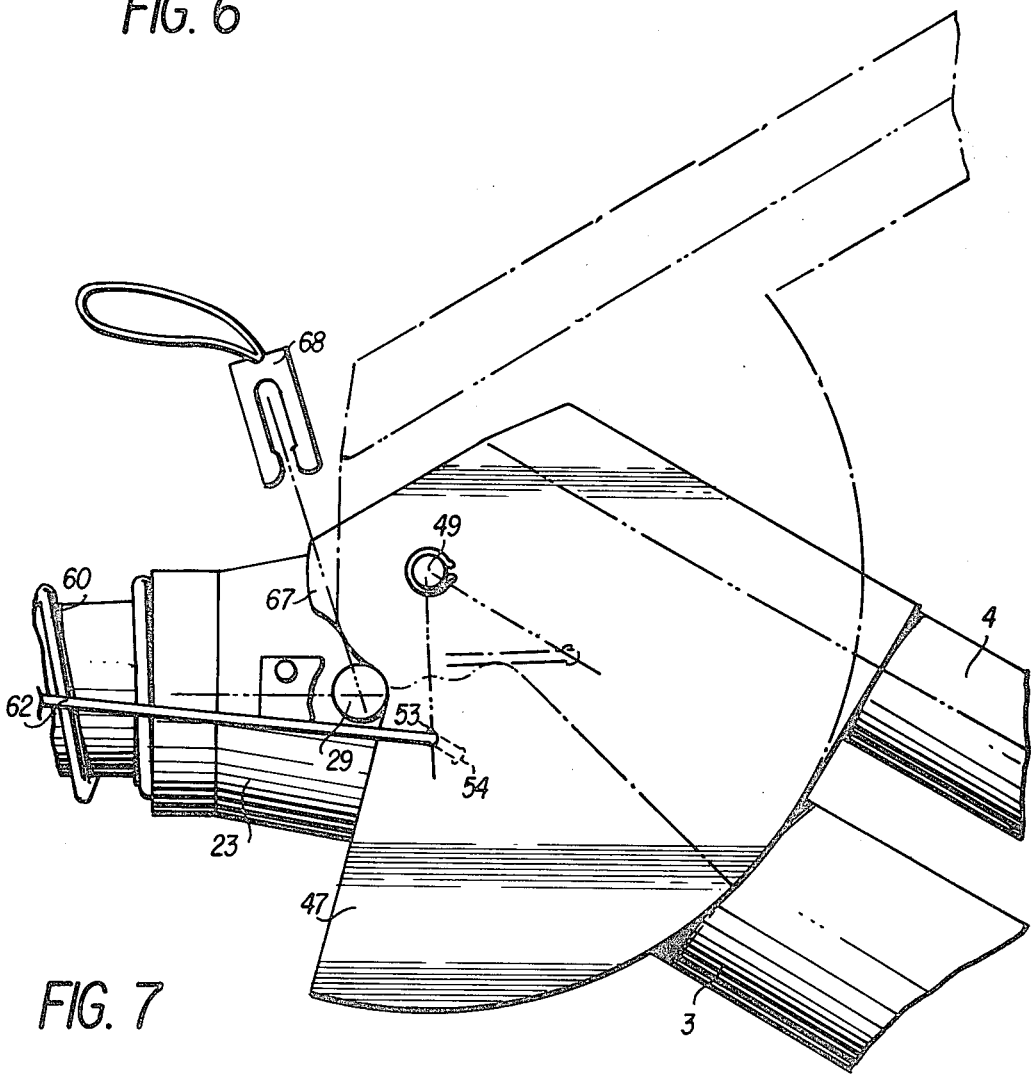
FIG. 7 is a rear view, relative to FIG. 2, of the articulation of the mobile arm of the cutter.

FIG. 3 shows how the plate 48 is secured by a link 51 to a sleeve 52 adapted to slide, without rotating, on the portion 22 of the body 2. More precisely, the link 51 is a rod having curved end 53 which is introduced into an aperture 54 in plate 48, and other curved end of which (of hook shape) is engaged in an aperture formed in a collar 55 fastened to the sleeve 52. The cutter also comprises a second link 62 similar to link 51, as shown in FIGS. 1 and 7. FIG. 4 shows a slot 56 and an aperture 57 permitting engagement of the rod 51. It also shows that the outer surface of 22 is not entirely circular-cylindrical, but includes planar faces for preventing the rotation of sleeve 52 on body portion 22.

FIG. 4 also shows that the gun barrel 8 comprises two pins 58 and 59 which are diametrically opposite relative to the axis of ejector 1 and are located in a plane including an angle of 45° with the plane of the figure. The ends, cut along the line IV—IV (FIG. 3) of the pins 58 and 59 are shown in FIG. 4.

A spring 60 is compressed between the base 61 of the portion 22, the diameter of which is larger than that of the remainder of 22, and a face of the collar 55. The spring 60 tends to space collar 55 away from base 61, i.e. to exert a pull on the links 51 and 62, thereby closing the cutter. The collar 55 has its edge notched at 63 and 64, the notches 63 and 64 being diametrically opposite and in the form of arcs of a circle. The center of the notches 63 and 64 are at the same distance from the axis of ejector 1 as the axes of the pins 58 and 59, the radius thereof larger than that of the pins. Furthermore, there are recessed in the thickness of collar 55, namely recesses 65 and 66 which are also diametrically opposite but are offset through 90° relative 63 and 64. The center of 65 and 66 are at the same distance from the axis 1 as the axes of 58 and 59.

It is recalled that the assembly of ejector 1 and body 2 is able to reotate in the barrel 8. The placing in operational position of the cutter is effected in the following manner: The cutter is opened, and the assembly of ejector 1 and body 2 is rotated in barrel 8 in such manner that the pins 58 and 59 pass respectively opposite 65 and 66, the collar 55 being spaced away from the barrel upon opening the arm 4. The spring 60 is tensioned, the assembly of ejector 1 and body 2 not being able to leave barrel 8, since it is maintained by pins 10 and 11. The pins or spindles maintain the collar 55 away from the barrel 8, thus maintaining opening of the cutter by the links 51 and 62. The hollow in the cups 65 and 66 prevents any rotation of the cutter. On the other hand, in the inoperative position, with the assembly of ejector 1 and body 2 in the barrel 8, the cutter must be closed, this being achieved by passing the pins 58 and 59 through the notches 63 and 64, thereby permitting the spring 60 to urge collar 55 which pulls the links 51 and 62 (i.e. 48 and 47), thereby closing the cutter. It should be noted that in order to pass from the closed inoperative position to the open position, it is necessary to manually open the arm 4 until the collar 55 is completely disengaged from the pins 58 and 59. Once recesses 65 and 66 are opposite the pins, this being obtained by rotating the assembly, the arm 4 is slightly released to engage the pins in 65 and 66, thereby preventing any subsequent unintentional rotation.

FIG. 7 shows in greater detail the plate 47 and, in particular, the heel 67 thereof. The plate 47 and its heel 67 have a thickness equal to or smaller than the width of the groove 35 formed in the head 29 of the piston 21. When the cutter is closed, the heel 67 is spaced away from the head 29 and leaves the latter free. When the cutter is open, the heel 67 is engaged in the groove 35 and prevents any movement of the piston 21. In fact, in the inoperative position of the cutter or when the latter is in storage (when it is normally closed) a clip 68 is engaged in the groove 35 to prevent any movement of the piston 21. Finally (as FIG. 6 shows) the head 29 is also protected against unintentional mechanical impacts by a protective lug 69 fixed by a screw or bolt to the portion 23. In FIG. 7, the open position of the cutter is indicated by the broken lines.

Figure 5:
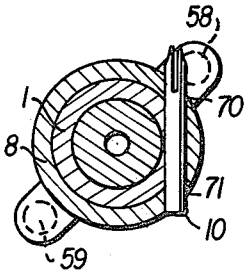

FIG. 5 which corresponds to a section taken along the line V—V of FIG. 3, shows how the tangent pin 10 at the bottom of the groove in the ejector 1 permits the assembly 1-2 to rotate in barrel 8, while preventing movements of translation. The sections of FIGS. 4 and 5 do not show in detail the interior of ejector 1 or body 2, which is already shown elsewhere. FIG. 5 shows furthermore, the bases of the pins 58 and 59. In FIG. 4 pin 59 is shown in broken lines to render recess 66 visible, the opposite being true for pin 58 and recess 65, respectively.

Figure 9:
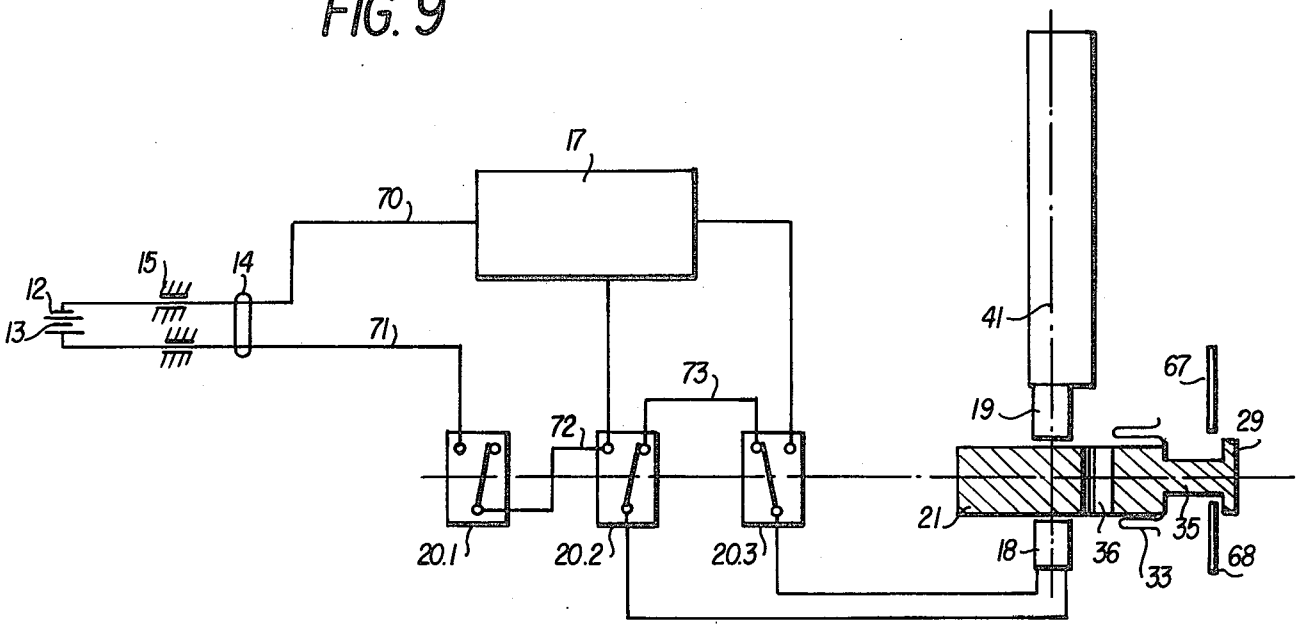
FIG. 9 shows a block diagram illustrating the functioning of the initiation of charging of the cutter.

FIG. 9 is a block diagram illustrating the electrical wiring diagram and permitting a more ready understanding of specific phases of functioning of the cutter of the invention. There are again shown the primary cells 12–13, the wires 14 comprising a wire 70 connected to the input of the delay circuit 17 and a wire 71 connected to a fixed contact of microswitch 20.1, the detonator 18, the piston 21, the pyrotechnical relay 19, the charge 41 and the microswitches 20.1, 20.2 and 20.3. The output of delay circuit 17 is connected to a fixed contact of 20.3. The common terminal of delay circuit 17 is connected to a fixed contact of 20.2, which is connected by the wires 72 to the mobile contact of 20.1. The second fixed contacts of 20.2 and 20.3 are connected by a wire 73. The mobile contact of 20.2 is connected to an input of detonator 18, whereas the mobile contact of 20.3 is connected to the other input of detonator 18. In the inoperative position of the piston 21, the mobile contact of 20.1 (in its illustrated position) disconnects wire 71 from wire 72, thereby preventing application of any signal to the circuit 17. On the other hand, the mobile contacts of 20.2 and 20.3, with the wire 73, short circuit the input of the detonator 18. Thus, there are two safety systems in cascade, which prevent triggering of the detonator 18. Even if the latter is detonated, the piston 21 being inoperative, the mass present between detonator 18 and pyrotechnical relay 19 would prevent initiation of pyrotechnical relay 19 and thus of explosive charge 41. Finally, it will be recalled that the piston is maintained in the inoperative position by the heel 67 of plate 47 or the clip 68, and that it is protected by the lug 69.

When the piston 21 passes into the operative position, it provides an empty space 36 between 18 and 19, and reverses the positions of the mobile contacts of 20.1, 20.2 and 20.3.

A description will now be given of the various stages of preparation of use of the cutter. In the storage condition, the ejector 1 is mounted on the body 2, the arm 4 of the cutter is closed and the clip 68 locks the piston 11. The spring 60, through the intermediary of the sliding sleeve and the links 51 and 62 brings the mobile arm into alignment with the active arm.

In order to mount the cutter on the gun barrel 8 of a submarine device, the assembly 1–2 is engaged in the barrel 8, leaving the arm 4 closed and engaging the pins 58 and 59 in the notches 63 and 64. The pin 10 is inserted through the apertures of 8 and locks the assembly 1 and 2 in translation in 8.

In order to cock the cutter, the mobile arm 4 is manually pivoted, thereby causing the sleeve 52 and the collar 55 to slide, through intermediary links 51 and 62, at the same time compressing the spring 60. Once the collar 55 has been freed from the pins 58, the assembly has rotated in the barrel (which remains fixed) through an angle of 90° and, upon slightly releasing the arm 4, the pins are introduced into the recesses 65 and 66, where they prevent the sleeve from returning to its inoperative position thus bringing about closure of the arms. The spring 60 is tensioned. The heel 67 of 47 locks the piston 21 and the clip 68 may be removed.

The pivotable arm 4 and fixed arm 3 then define a sector which is preferably in a horizontal plane and in the field of a television camera mounted on the submarine device.

The device is introduced into the water and guided by telecontrol towards the apparatus to be cut, which may be a cable, a buoy-rope, a rod, etc. When this apparatus is within the sector formed by the arms 3 and 4, a telecontrol order is supplied to a circuit of the submarine device which transmits it to the igniter 6 of the ejector 1 through the pin 5. The thrust of the gases produced ejects the body 2, cutting the pin 11, the ejector 1 remaining in the barrel 8.

The collar 55 no longer bears on the pins 58 and 59 of 8. The spring 60 is detensioned and, through the intermediary links 51 and 62, the arm 4 is closed against the arm 3, enclosing the object to be cut.

On reclosing, the arm 4 unlocks the piston 21 which, under the effect of a hydrostatic pressure, passes into the working position and changes the state of the contacts 20.1, 20.2 and 20.3. The inputs of the circuit 17 are connected to the terminals of the primary cells 12 and 13 which, on ejection and only from that instant on, are primed by contact with the sea water. The detonator 18 is connected to the outputs of circuit 17. After the propagation delay of the signal applied by the primary cells to the circuit 17, through this same delay circuit 17, the detonator receives its signal 17. Said delay may be for example a 20 minute delay, thereby making it possible to recover the submarine device.

The detonator 18 functions and excites through open passage 36 the pyrotechnical relay 19 which initiates the explosive charge 41, as stated herinabove. A planar explosive jet, normal to the direction of the arm 3, caused by the explosion of charge 41 is propogated from one end to the other of arm 3 and cuts any article situated between arms 3 and 4.

What is claimed is:

1. A pyrotechnic cutter for cutting an object such as a buoy-rope, tube, cable or the like, comprising a fixed arm containing over substantially its entire useful length an explosive charge having a dihedral covering, the plane of symmetry of the dihedral covering, which substantially corresponds to the plane of a cutting jet comprising gases resulting from explosion of said explosive charge, being directed toward a second arm of the cutter, said second arm being pivotally mounted at one end of said fixed arm, such that explosion of said explosive charge cuts an object enclosed between the two arms; said one end of said fixed arm being fastened to a body releasably connected to an ejector adapted to be engaged in a gun barrel, and an end of the second arm being pivotally connected to said body, said body also carrying control means for maintaining said arms in a separated, open position until said ejector functions, and for closing the second arm toward the first arm upon separation of said body from the ejector, and means in said body for initiating detonation of the explosive charge in the fixed arm at a delayed time after separation of said body from the ejector.

2. The cutter of claim 1, additionally comprising means for conveying initiation of detonation of said charge simultaneously to three diverse points, one of said points being in said plane of symmetry and the other two points being located symmetrically relative to said plane of symmetry.

3. The cutter of claim 1, wherein said ejector is formed for rotating in a gun barrel and for adopting two distinct positions of rotation, one wherein said control means simultaneously causes said second arm to assume a third, slightly closed position, and another wherein said control means is free for maintaining and closing the second arm.

4. The cutter of claim 1, wherein said means for initiating detonation of the explosive charge comprises an electrical circuit and a pyrotechnic circuit, the electrical circuit comprising a source of primary energy, a delay circuit and a switching circuit respectively connected so that the source of primary energy functions as a means for providing activating energy at a time after separation of the body from the ejector, and for transmitting a signal to the delay circuit, for transmitting an output signal from the delay circuit to the switching circuit, the pyrotechnic circuit comprising a detonator and pyrotechnic relay means for conveying initiation of detonation of said charge to three diverse points on said charge, the switching circuit being connected to said detonator for transmitting an activating signal thereto.

5. The cutter of claim 4, wherein said source of primary energy comprises primary cells activatable by water.

6. The cutter of claim 5, wherein said cells are located in a fluid-tight cavity in the body for activation by water upon separation of said body from the ejector.

7. The cutter of claim 6, wherein said cells are activatable by sea water.

8. The cutter of claim 4, additionally comprising a hydrostatic piston in said body for mechanically controlling the switching circuit, said piston slidable between an inoperative position where the connection between the switching circuit and the detonator is short-circuited and the output of the delay circuit is disconnected, and an operative position wherein the output of the delay circuit is operatively connected to the detonator.

9. The cutter of claim 8, wherein said hydrostatic piston is movable into its operative position by hydrostatic pressure on the exterior of said body.

10. The cutter of claim 8, wherein said piston comprises a head which in the inoperative position projects externally from said body, with a radial groove in said piston head for accepting locking means for maintaining the piston in its inoperative position thereby preventing accidential depression of the piston.

11. The cutter of claim 10, wherein said locking means comprises a locking clip.

12. The cutter of claim 10, wherein said locking means comprises the heel of a plate connected to and pivotal with the second arm for maintaining the piston in its inoperative position when the arms are in their separated, open position.

13. The cutter of claim 10, wherein a central portion of said piston is located between the detonator and the pyrotechnic relay means, a solid portion of said piston physically separating the detonator and pyrotechnic relay means when the piston is in its inoperative position, and a hole extending radially through said piston permitting activation of the pyrotechnic relay means by the detonator when the piston is in its operative position.

14. The cutter of claim 1, which engages the free end of a gun barrel, and with two pins aligned parallel to the axis of the barrel-ejector-body assembly and connected to said barrel, said control means comprising a sleeve for sliding on said body along the direction of said axis without rotating about said axis, and a collar integral with said sleeve said collar having two notches in the periphery thereof at diametrically opposite points with respect to each other, and at the same radial distance from said axis as said pins, and offset by 90° with respect to a similar pair of recesses in said periphery also at diametrically opposite points with respect to each other, a spring constantly urging the sleeve axially toward the ejector, the ejector-body assembly having an initial inoperative position wherein the pins engagingly pass through the notches in the collar permitting said spring to urge the sleeve toward the ejector thereby closing the second arm toward the fixed arm, and an operative position wherein the second arm is pivoted away from the fixed arm and the body is rotated 90° from the initial inoperative position so that the tips of said pins rest in said recesses, the sleeve then being farther from the end of the gun barrel and compressing the spring.

15. The cutter of claim 14, wherein said second arm is operatively connected to the sleeve by links for transmitting the movement of said sleeve to said second arm.

16. The cutter of claim 14, wherein the ejector additionally comprises an electrical igniting means for triggering ejection of the body, said igniting means connected to a further pin which engages the gun barrel and is connected for communicating an electrical signal for triggering ejection.

* * * * *